US007703849B2

(12) United States Patent
Bilak et al.

(10) Patent No.: US 7,703,849 B2
(45) Date of Patent: Apr. 27, 2010

(54) VERTEBRAL COLUMN SUPPORT APPARATUS AND METHOD

(75) Inventors: Mark Ronald Bilak, Fuquay-Varina, NC (US); Ronald Edward Bilak, Seneca Falls, NY (US)

(73) Assignee: B&B Innovators, LLC, Fuquay-Varina, NC (US)

( * ) Notice: Subject to any disclaimer, the term of this patent is extended or adjusted under 35 U.S.C. 154(b) by 272 days.

(21) Appl. No.: 11/615,575

(22) Filed: Dec. 22, 2006

(65) Prior Publication Data

US 2008/0150337 A1 Jun. 26, 2008

(51) Int. Cl.
*A47C 4/54* (2006.01)

(52) U.S. Cl. ..... 297/284.6; 297/284.1; 297/284.5; 297/230.13; 297/230.14; 297/452.41

(58) Field of Classification Search ... 297/284.1–284.7, 297/230.1, 230.13, 230.14, 452.41, 452.29, 297/452.33, 452.34, 452.35
See application file for complete search history.

(56) References Cited

U.S. PATENT DOCUMENTS 3,099,483 A * 7/1963 Hofberg ..... 297/219.1
3,348,880 A * 10/1967 Swann ..... 297/228.13
3,628,832 A * 12/1971 Jennings ..... 297/451.1
3,716,270 A * 2/1973 Frazier ..... 297/452.33
3,740,096 A * 6/1973 Bridger ..... 297/452.25
4,097,087 A * 6/1978 Garavaglia ..... 297/284.7
4,161,337 A * 7/1979 Ross et al. ..... 297/230.12
4,331,361 A 5/1982 Krakauer
4,634,176 A * 1/1987 Scott ..... 297/284.5
4,676,550 A * 6/1987 Neve De Mevergnies ... 297/353
4,718,724 A * 1/1988 Quinton et al. ..... 297/284.5
4,744,603 A 5/1988 Knoblock
4,759,543 A * 7/1988 Feldman ..... 482/148
4,776,633 A 10/1988 Knoblock et al.
4,834,455 A * 5/1989 Proctor ..... 297/353
4,852,945 A 8/1989 Rowles et al.
4,862,536 A * 9/1989 Pruit ..... 297/284.5
4,864,668 A * 9/1989 Crisp ..... 5/653
4,876,755 A * 10/1989 Parrish ..... 297/284.3
4,944,554 A 7/1990 Gross et al.
5,114,209 A * 5/1992 Dunn ..... 297/230.1
5,314,235 A * 5/1994 Johnson ..... 297/284.5
5,558,398 A 9/1996 Santos
5,816,654 A * 10/1998 Ellis ..... 297/284.5
5,975,632 A * 11/1999 Ginat ..... 297/284.7
6,132,004 A * 10/2000 Carlino ..... 297/452.48

(Continued)

FOREIGN PATENT DOCUMENTS

EP 0154582 * 9/1985

*Primary Examiner*—Laurie K Cranmer

(57) ABSTRACT

The methods and apparatus taught herein provide an elongated spine support member integrated into or attached to a chair for providing improved back support. According to one embodiment of a chair, the chair comprises a seat, back and elongated spine support member. The back includes inner and outer sections. The inner section is spaced inwardly from opposite sides of the back and extends generally vertically through a substantial portion of the height of the back. The outer section extends along opposite sides of the inner section. The elongated spine support member is generally vertically extending and forms a part of the inner section of the back. The elongated spine support member is configured to engage and support at least two of the cervical, thoracic and lumbar regions of the vertebral column of a person seated in the chair.

17 Claims, 7 Drawing Sheets

U.S. PATENT DOCUMENTS 6,309,018 B1 * 10/2001 Jernstrom ..... 297/284.1
6,332,651 B1 * 12/2001 Horisawa ..... 297/452.11
6,467,841 B1 10/2002 Henschel et al.
6,578,916 B2 * 6/2003 Longhi et al. ..... 297/284.3
6,589,143 B2 * 7/2003 Taylor ..... 482/134
6,688,686 B1 * 2/2004 McEvoy et al. ..... 297/284.4
6,755,467 B1 * 6/2004 Chu ..... 297/284.1
6,848,744 B1 * 2/2005 Raftery et al. ..... 297/284.1
6,969,114 B2 11/2005 Keilhauer
6,969,115 B2 11/2005 Bourdkane et al.
6,986,549 B2 * 1/2006 Kniese ..... 297/284.1
7,052,087 B2 * 5/2006 McMillen ..... 297/284.4
7,059,678 B1 6/2006 Taylor
7,080,885 B2 7/2006 Bain et al.
7,083,234 B2 * 8/2006 Dowty et al. ..... 297/314
7,344,196 B2 * 3/2008 Rodriquez ..... 297/452.41
7,413,250 B2 * 8/2008 Connolly et al. ..... 297/284.6
2002/0130540 A1 9/2002 Rajasingham
2002/0180249 A1 * 12/2002 Felton et al. ..... 297/284.6
2003/0038517 A1 * 2/2003 Moran et al. ..... 297/284.3
2003/0227201 A1 12/2003 Keilhauer
2004/0070239 A1 4/2004 Dellanno
2004/0095006 A1 * 5/2004 Chen ..... 297/284.6
2004/0135409 A1 7/2004 Bourdkane et al.
2004/0174056 A1 * 9/2004 Gryp et al. ..... 297/284.6
2005/0104428 A1 * 5/2005 Walker et al. ..... 297/284.4
2005/0104435 A1 5/2005 Bain et al.
2006/0061169 A1 3/2006 Kohl et al.
2007/0001505 A1 * 1/2007 Marshall et al. ..... 297/452.41

* cited by examiner

VERTEBRAL COLUMN SUPPORT APPARATUS AND METHOD

BACKGROUND

The present invention generally relates to vertebral column support, and particularly relates to supporting multiple regions of the vertebral column of a person seated in a chair.

The vertebral column (backbone or spine) of a human supports approximately half the weight of the human body while muscles support the other half. The vertebral column comprises four regions: cervical, thoracic, lumbar, and sacral (or pelvic). Each region of the spine comprises various vertebral bodies separated by discs. The vertebral bodies act as a support column to hold up the spine. The vertebral column protects sensitive nerve roots while providing mobility. The vertebral column is subjected to various types of loads, particularly when a person is seated. Excessive loading of the spine over time often leads to back pain, particularly caused by improper posture while seated.

Conventional chairs include a padded or pellicle (mesh) back for providing general support to a person's back when seated. Chair backs come in various sizes, heights, and contours for providing general back support. Some conventional chair backs are modified to include additional padding for providing targeted support to a particular part of the back, most commonly the lumbar region.

The lumbar region of the spine loses its curvature when a person is seated, thus increasing the load placed on the lower back. To relieve some of this pressure, a conventional lumbar support exerts a force on the lumbar region, imparting a desired curvature on the lower spine. Particularly, a lumbar support pushes the lumbar region forward, forcing the person to slightly arch their lower back and thus maintain proper curvature in the lumbar region.

Regions of the vertebral column other than the lumbar are also subjected to excessive loading when a person is seated. Pain and discomfort in the upper and/or middle back often arises over time if the cervical and/or thoracic regions of the spine are not properly supported when a person is seated. Further, preexisting spine injuries or conditions often cause back pain or discomfort if the cervical and/or thoracic regions of the spine are not properly supported when a person is seated.

SUMMARY

The methods and apparatus taught herein provide an elongated spine support member for providing improved back support. In some embodiments, the elongated spine support member is integrated into a portable back support. In other embodiments, the elongated spine support member is integrated into or attached to a chair.

According to one embodiment of a chair, the chair comprises a seat, back and elongated spine support member. The back includes inner and outer sections. The inner section is spaced inwardly from opposite sides of the back and extends generally vertically through a substantial portion of the height of the back. The outer section extends along opposite sides of the inner section. The elongated spine support member is generally vertically extending and forms a part of the inner section of the back. The elongated spine support member is configured to engage and support at least two of the cervical, thoracic and lumbar regions of the vertebral column of a person seated in the chair.

Of course, the present invention is not limited to the above features and advantages. Those skilled in the art will recognize additional features and advantages upon reading the following detailed description, and upon viewing the accompanying drawings.

DRAWING DESCRIPTIONS

WRITTEN DESCRIPTION

Figure 1:
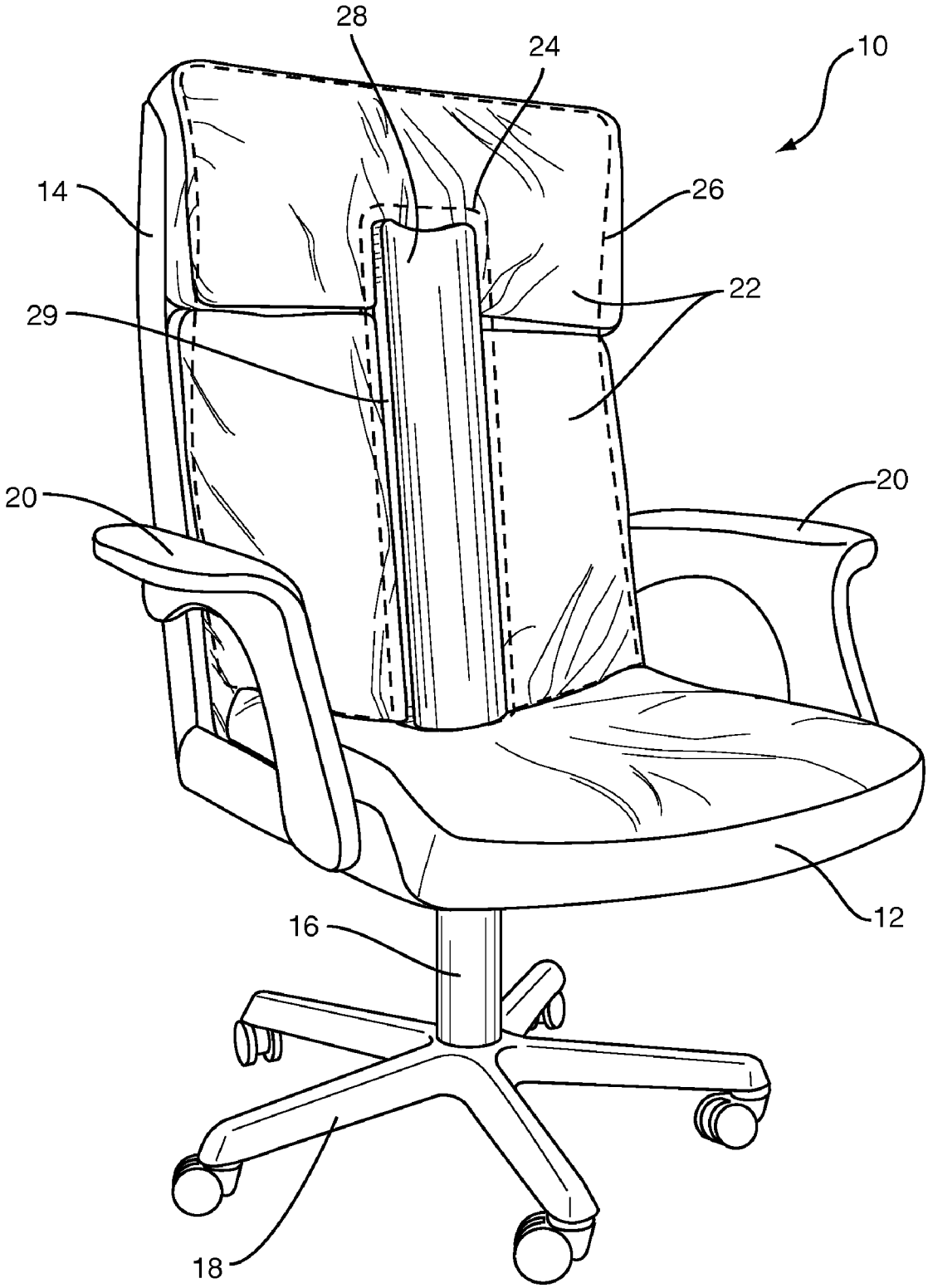
FIG. 1 illustrates one embodiment of a chair including an elongated spine support member.

FIG. 1 illustrates one embodiment of a chair 10 including a seat 12, back 14, support column 16, base 18 and arm rests 20. The chair back 14 includes padding 22 such as foam or any other suitable material(s) for providing general support to the back of a person seated in the chair 10. The chair back 14 has inner and outer sections 24 and 26, respectively. The inner and outer sections 24 and 26 may be continuous, partly continuous or separate. The inner section 24 is spaced inwardly from opposite sides of the chair back 14. The inner section 24 generally extends vertically when the chair back 14 is in an upright position. The inner section 24 extends through a substantial portion of the height of the chair back 14. The outer section 26 extends along opposite sides of the inner section 24. The outer section 26 also extends above the inner section 24 if the inner section 24 does not extend fully through the entire height of the chair back 14.

Figure 2:
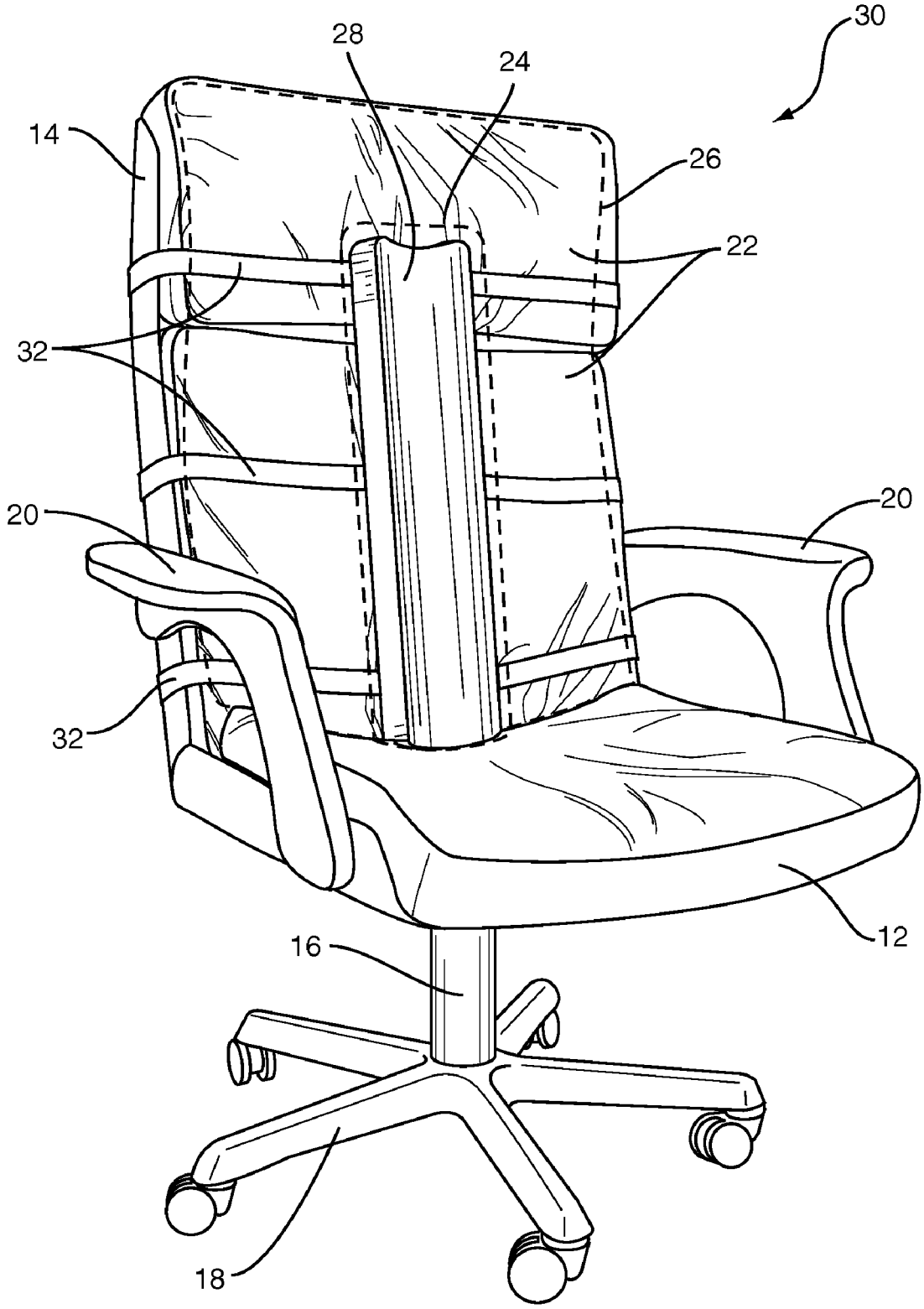
FIG. 2 illustrates another embodiment of a chair including an elongated spine support member.

An elongated spine support member 28 forms a part of the inner section 24. According to this embodiment, the spine support member 28 is integrated into the chair back 14 along with the padding 22. In other embodiments, the spine support member 28 is attached to a chair 30, e.g., by straps 32 as shown in FIG. 2 or other fastening mechanism. Regardless, the spine support member 28 generally extends vertically when the chair back 14 is in an upright position.

The elongated spine support member 28 improves back support by engaging and supporting at least two of the cervical, thoracic and lumbar regions of the vertebral column of a person seated in the chair 10. Force is exerted on the vertebral column when a person is seated. The spine support member 28 absorbs part of the force exerted on the vertebral regions engaged by the support member 28, thus providing stress relief to the spine when a person is seated. The spine support member 28 may also impart a desired curvature upon the engaged regions of the vertebral column or prevent undesired curvature as will be described in detail later, thus maintaining proper posture. As such, multiple regions of the vertebral column are engaged and supported by the elongated spine support member 28 when a person is seated.

The elongated spine support member 28 may comprise any kind of material or combination of materials and be of any elongated shape or configuration sufficient to engage and support multiple regions of the vertebral column of a seated person. As such, the spine support member 28 provides additional support beyond that provided by backing found in conventional chairs. Preferably, the spine support member 28 has a width sufficient to support the vertebral regions engaged by the spine support member 28.

In some embodiments, the elongated spine support member 28 includes a generally curved front surface vertically extending over the height of the support member 28 as shown in FIG. 1. Preferably, the curvature is convex to cup or otherwise partially surround the posterior surface of the engaged regions of the vertebral column. Alternatively or additionally, the spine support member 28 may have a curvature extending in an axial direction toward the front of the chair 10 that complements the curvature of the vertebral column. For example, if the thoracic and lumbar regions are engaged by the spine support member 28, the member 28 may have a curvature that complements respective curvatures of the thoracic and lumbar regions. In other embodiments, the front surface of the spine support member 28 is initially flat, but conforms to a curvature of the vertebral column responsive to a force exerted by the engaged regions of the spine.

The elongated spine support member 28 may have a region 29 that extends outwardly from the chair back 14 toward a seating region of the chair 10 as shown in FIG. 1, the seating region being the region of the chair 10 that accommodates a person when seated. Because the extended region 29 protrudes from the chair back 14 into the seating region, the spine support member 28 contacts the vertebral column before the padding 22 when a person sits. As such, the spine support member 28 engages the vertebral column as a person sits in the chair 10 before the remainder of the chair back 14, thus providing improved back support.

Figure 3:
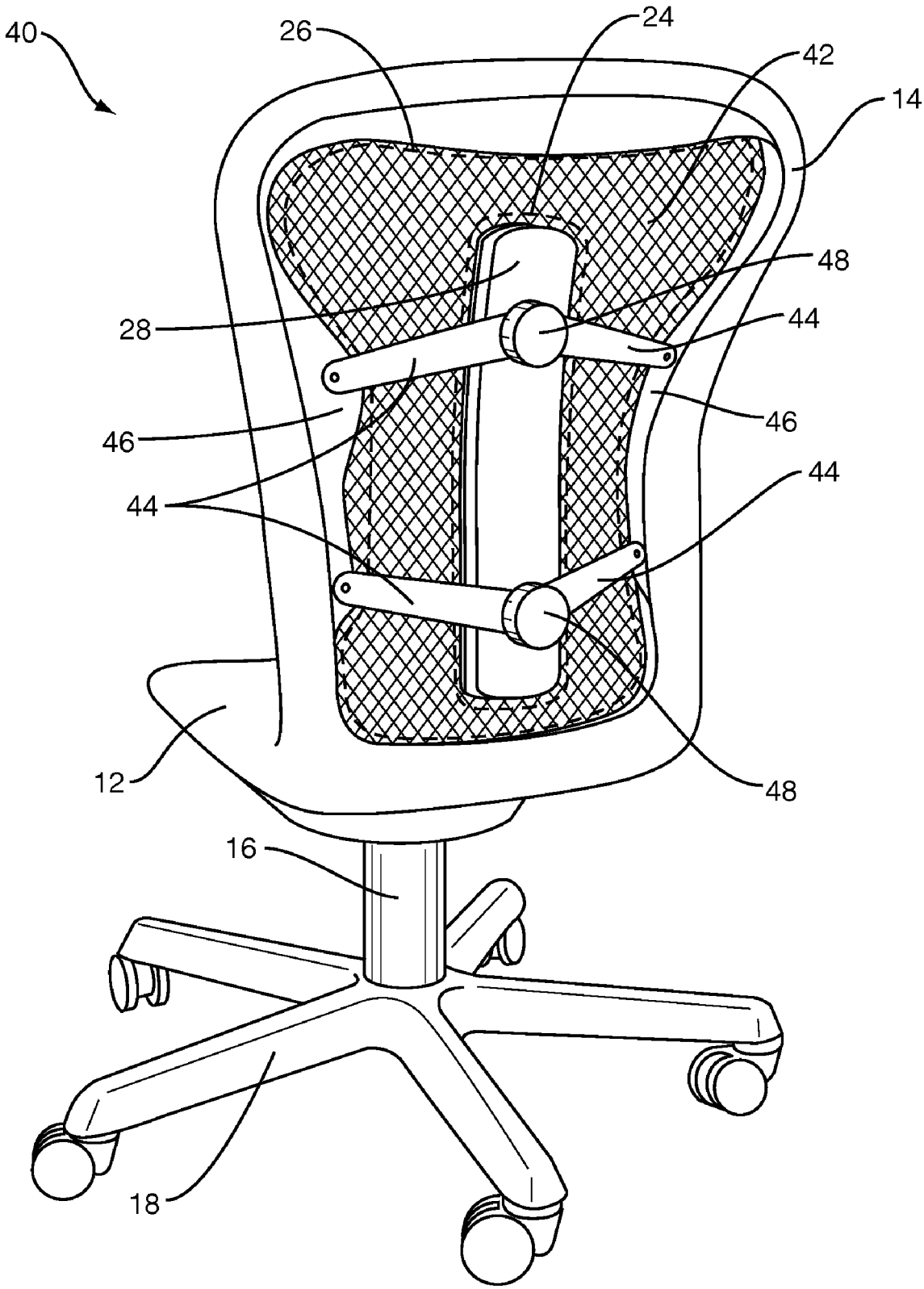
FIG. 3 illustrates yet another embodiment of a chair including an elongated spine support member.

FIG. 3 illustrates yet another embodiment of a chair 40 including the elongated spine support member 28. According to this embodiment, the chair back 14 has a pellicle (e.g., mesh) backing 42 that forms the inner and outer sections 24 and 26 of the chair back 14, respectively. Thus, the inner and outer sections 24 and 26 are continuous in this embodiment. The spine support member 28 is attached to the rear of the chair back 14. In one embodiment, one or more arms 44 attach the spine support member 28 to a rear mounting surface 46 of the chair back 14. According to this embodiment, the spine support member 28 is in contact with a rear surface of the inner section 34 of the pellicle 42.

When a person sits in the chair 40, their back contacts a front surface of the pellicle 42, the pellicle 42 providing general support to the person's back. The spine support member 28 improves upon the support provided by the pellicle 42 by exerting a force against the rear surface of the pellicle 42 in an axial direction toward the seating region of the chair 40, i.e., toward the front surface of the inner section 24 of the pellicle 42. By exerting such an axial force, the spine support member 28 engages and supports at least two of the cervical, thoracic and lumbar regions of the vertebral column of a person seated in the chair 40.

In one embodiment, the amount of support provided by the elongated spine support member 28 corresponds to the rigidity of the arms 44 that attach the support member 28 to the rear mounting surface 46 of the chair back 14. That is, the amount of axial movement by the spine support member 28 is a function of how rigid the arms 44 are. When the vertebral column is pressed against the spine support member 28, the support member 28 is forced away from the seating region and toward the rear of the chair 40. The support member 28 has less axial movement when the arms 44 are rigid, thus providing more vertebral support. However, if the arms 44 are less rigid, the spine support member 28 will be pushed further toward the rear of the chair 40 when the vertebral column exerts a force against the spine support member 28. In another embodiment, axial movement of the spine support member 28 is controlled by one or more tension-adjusting knobs 48. By turning or otherwise adjusting the knobs 48 accordingly, the amount of axial movement by the spine support member 28 may be set as desired.

Figure 4:
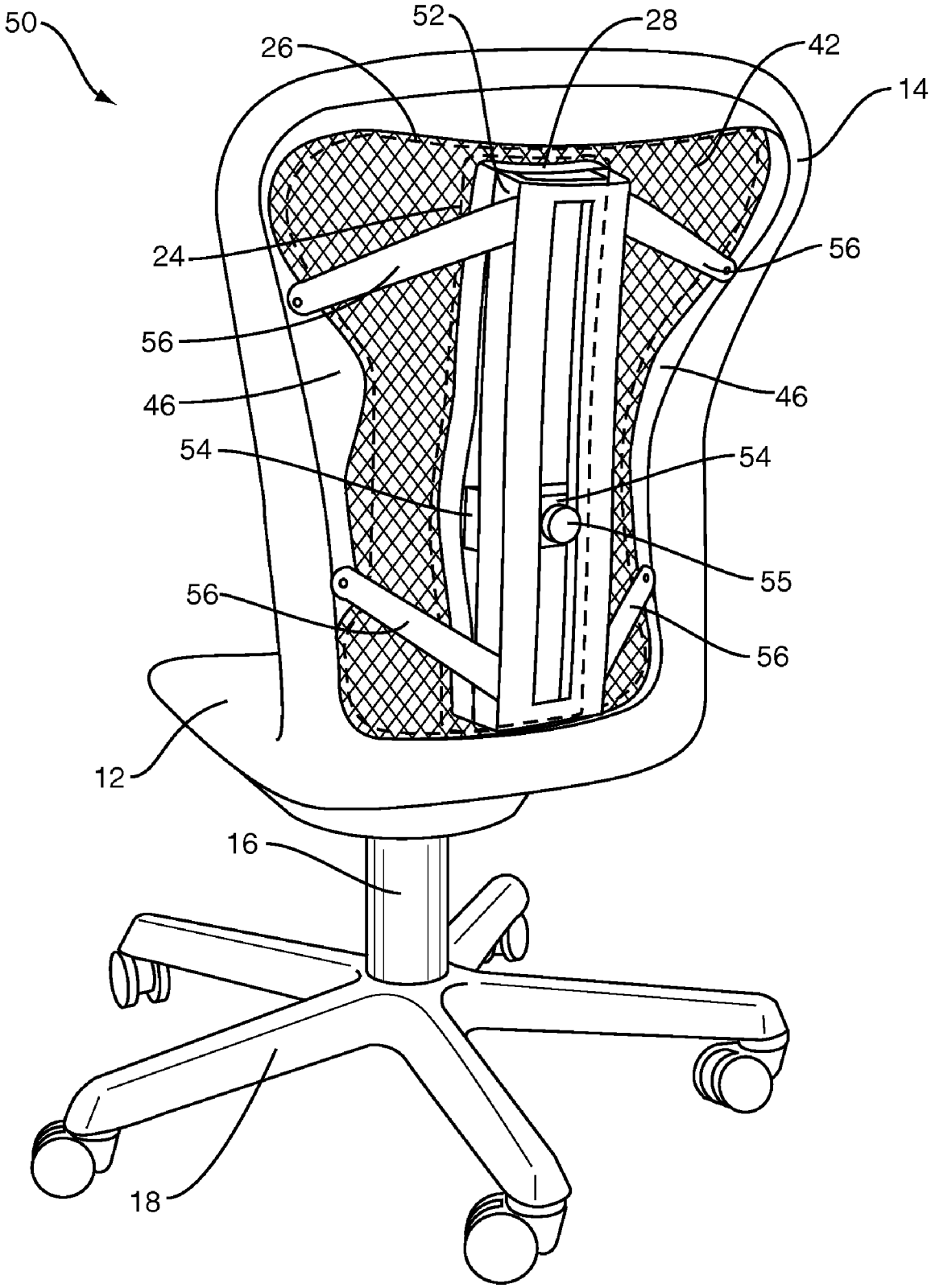
FIG. 4 illustrates still another embodiment of a chair including an elongated spine support member.

FIG. 4 illustrates still another embodiment of a chair 50 including a guide 52 such as a track or similar structure to which the elongated spine support member 28 is attached. The spine support member 28 is positioned between the guide 52 and a rear surface of the pellicle 42. The guide 52 at least partially houses a moveable member 54 and is attached to the rear mounting surface 46 of the chair back 14, e.g., via a plurality of arms 56.

The moveable member 54 imparts a curvature upon the elongated spine support member 28 in an axial direction toward the seating region of the chair 50 as shown in FIG. 4. The degree of curvature imparted by the moveable member 54 is adjustable by changing the depth at which the member 54 protrudes longitudinally toward the spine support member 28. For example, an adjustment mechanism 55 attached to the moveable member 54 may be turned, pressed or otherwise adjusted to longitudinally extend or retract the moveable member 54. The further the moveable member 54 extends toward the spine support member 28, the more curvature imparted on the support member 28.

The curvature imparted upon the spine support member 28 has a vertex along the length of the support member 28. The curvature vertex may be changed by sliding the moveable member 54 along the guide 52. Thus, both the degree and point of curvature imparted on the spine support member 28 may be adjusted by longitudinally and vertically adjusting the moveable member 54 at least partially housed within the guide 52, respectively.

Figure 5:
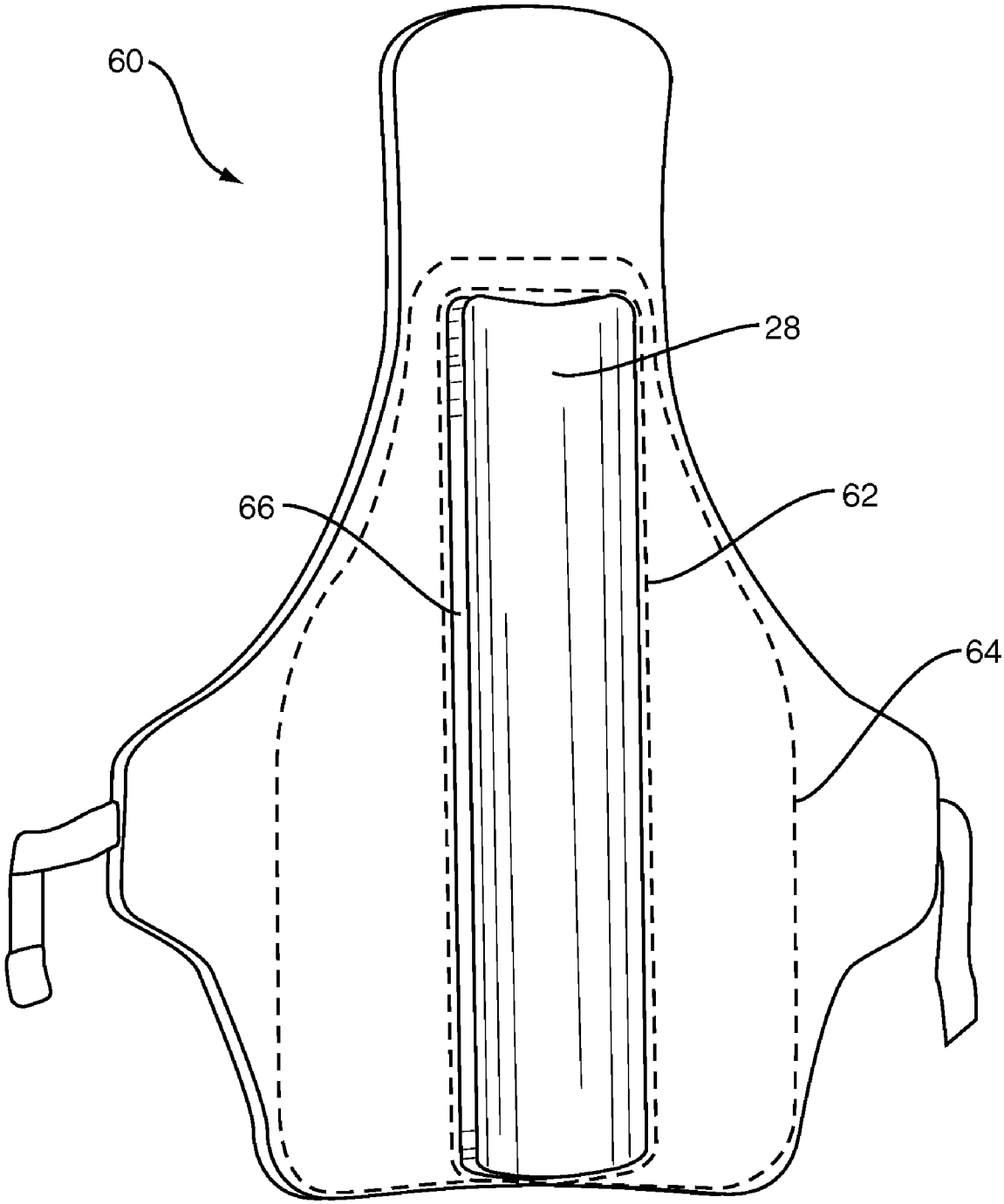
FIG. 5 illustrates an embodiment of portable back support including an elongated spine support member.

The elongated spine support member 28 may also be integrated into or attached to a portable back support for use with chairs or seats. FIG. 5 illustrates an embodiment of a portable back support 60 having inner and outer sections 62 and 64, respectively. The inner section 62 is spaced inwardly from opposite sides of the portable back support 60 and extends generally vertically through a substantial portion of the height of the portable back support 60. The outer section 64 extends along opposite sides of the inner section 62. The inner and outer sections 62 and 64 may comprise padding or other similar material for providing general back support. The spine support member 28 forms a part of the inner section 62 and engages and supports at least two of the cervical, thoracic and lumbar regions of the vertebral column of a person seated against the portable back support 60.

The elongated spine support member 28 may have a region 66 that extends outwardly from a front surface of the portable back support 60. Because the extended region 66 protrudes outwardly from a front surface of the portable back support 60, the spine support member 28 makes contact with the vertebral column before other regions of the portable back support 60 when a person sits against the portable support 60, thus providing improved back support. The portable back support 60 may be used with any type of chair such as an office chair, car seat, etc., to provide additional back support.

Figure 6:
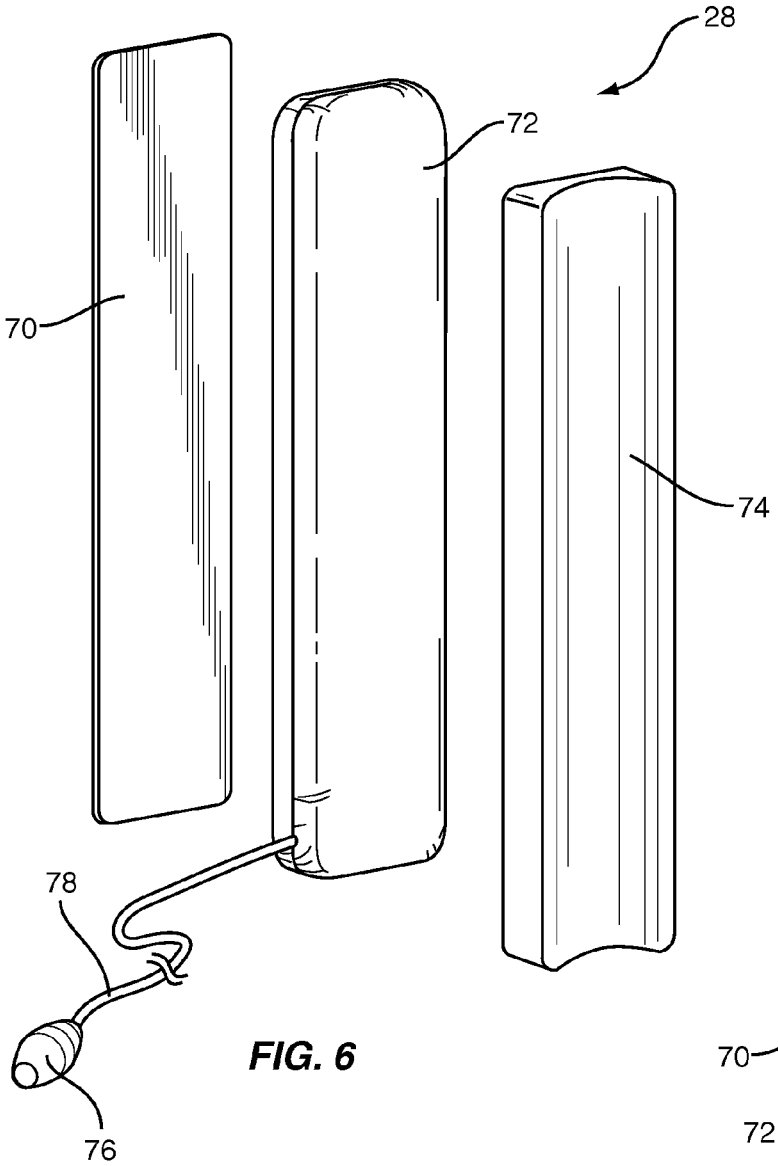
FIG. 6 illustrates one embodiment of an elongated spine support member.
Figure 7:
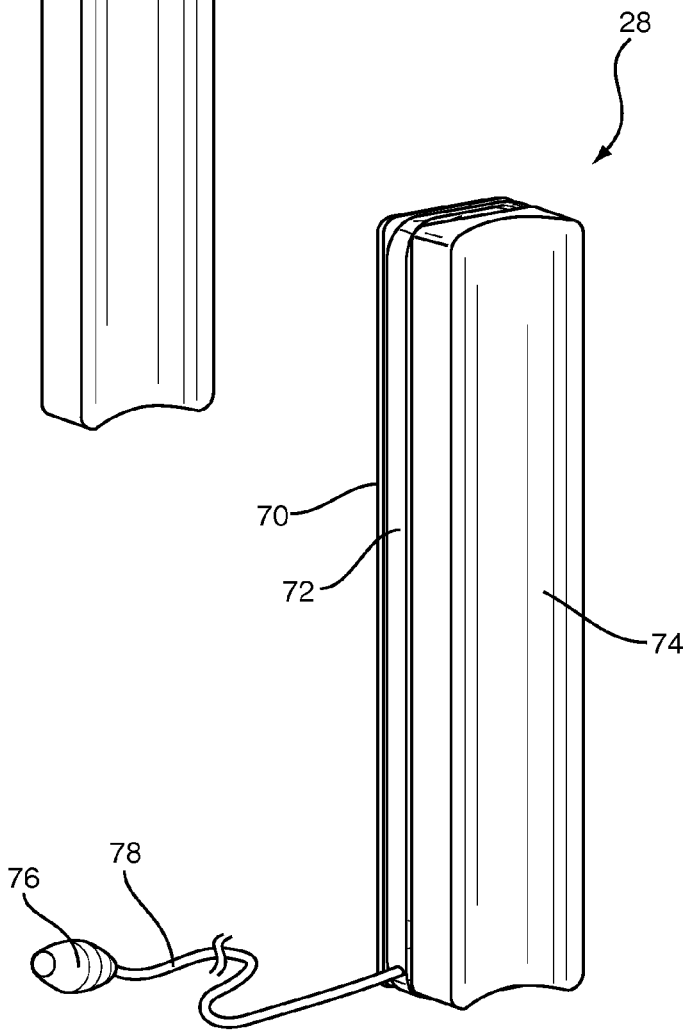
FIG. 7 illustrates another embodiment of an elongated spine support member.

FIG. 6 illustrates one embodiment of the elongated spine support member 28. According to this embodiment, the spine support member 28 comprises a backing layer 70 and one or more conforming layers 72 and 74. The layers 72 and 74 are conforming in that they conform to the shape of the vertebral regions engaged by the spine support member 28. In one embodiment, the first conforming layer 72 comprises a chamber and the second conforming layer 74 comprises viscoelastic foam (memory foam). The conforming layers 72 and 74 engage and support the vertebral column. The spine support member 28 may comprise the backing layer 70 and either one of the conforming layers 72 or 74, or both layers 72 and 74, e.g., as shown in FIG. 7.

A pump 76 attached to the chamber 72, e.g., via a tube 78, controls the amount of air (or other substance) contained in the chamber 72. A valve (not shown) releases the contents of the chamber 72. The pump 76 and valve may be manually operated (e.g., by hand) or may be automatically operated (e.g., by remote or push-button control). Either way, a desired amount of vertebral support may be obtained by adjusting the amount of air (or other substance) contained in the chamber 72. The contents of the chamber 72 are displaced responsive to a force applied by the vertebral column against the spine support member 28. The chamber 72 may be filled with a substance other than air that conforms to and supports multiple regions of the vertebral column such as a liquid, gel or the like.

Figure 8:
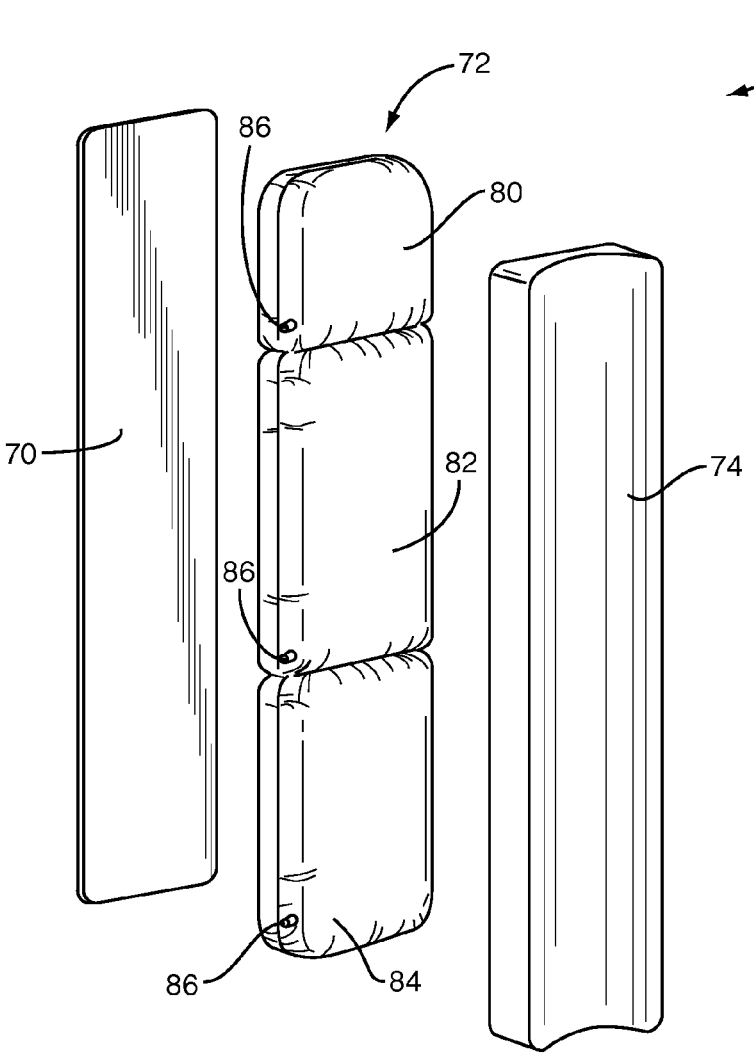
FIG. 8 illustrates yet another embodiment of an elongated spine support member.

In some embodiments, the chamber 72 comprises a single continuous chamber for engaging and supporting multiple regions of the vertebral column. In other embodiments, the chamber 72 comprises separate chambers 80-84 as shown in FIG. 8. Air (or other substance) may be independently added or removed from individual ones of the chambers 80-84, e.g., via respective valves 86. Each separate chamber 80-84 may support and engage a particular region of the vertebral column. As such, different vertebral regions may be supported independently of the others. For example, the upper chamber 80 may support the cervical region of the vertebral column while the middle chamber 82 supports the thoracic region and the lower chamber 84 supports the lumbar. The contents of each chamber 80-84 may be individually adjusted to provide tailored support to different regions of the vertebral column.

The second conforming layer 74 (e.g., viscoelastic foam) also engages and supports multiple regions of the vertebral column. For example, the second conforming layer 74 may have a preformed curved front surface as shown in FIGS. 6-8 for cupping or otherwise partially surrounding the posterior surface of the engaged regions of the vertebral column. Alternatively, the second conforming layer 74 may have a substantially flat front surface. The front surface conforms to a curvature of the vertebral column responsive to the vertebral column being pressed against the spine support member 28, e.g., the second conforming layer 74 may comprise viscoelastic foam that conforms to the vertebral column in response to pressure and body temperature.

The backing layer 70 is a mechanism for integrating or attaching the elongated spine support member 28 to a chair or portable back support. For example, the straps 32 attaching the spine support member 28 to the chair 30 may be attached to the backing layer 70, which is in turn attached to one of the conforming layers 72 or 74. Likewise, the arms 44 attaching the spine support member 28 to the chair 40 may be attached to the backing layer 70. The backing layer 70 protects the conforming layer(s) 72 and/or 74 of the spine support member 28 from damage, particularly if a chamber is used which may be punctured if a protective layer such as the backing layer 70 is not used. The backing layer 70 may be rigid or flexible. In one embodiment, the backing layer 70 is flexible and is positioned between one of the conforming layers 72 or 74 and the track 52 of the chair 50. Accordingly, the moveable member 54 imparts curvature on the backing layer 70, which in turn imparts curvature on the one or more of the conforming layers 72 and 74. As such, a flexible backing layer 70 enables one or both of the conforming layers 72 and 74 to be shaped without causing damage to the support member 28.

Figure 9:
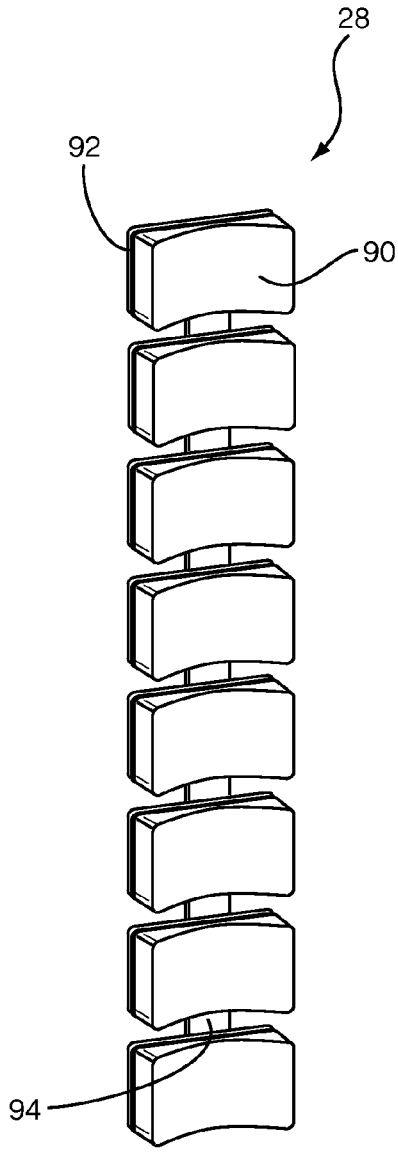
FIG. 9 illustrates still another embodiment of an elongated spine support member.

FIG. 9 illustrates another embodiment of the elongated spine support member 28. According to this embodiment, the spine support member 28 is segmented into multiple sections. Each section includes at least one conforming layer 90 such as viscoelastic form or a chamber filled with a substance such as air, liquid, gel or the like that conforms to part of the vertebral column. A backing layer 92 is attached to the conforming layer 90 of each section. Each backing layer 92 is attached to an elongated central support structure 94. The central support structure 94 keeps the sections interconnected and also enables the spine support member 28 to be integrated into or attached to a chair or portable back support such as those illustrated in FIGS. 1-5 and previously explained herein. Of course, multiple conforming layers may form part of the elongated spine support member 28.

In some embodiments, the elongated spine support member 28 includes one or more heating and/or cooling devices (not shown) such as one or more thermoelectric devices or the like. Heating and/or cooling the vertebral column (or cycling between both) provides further back pain relief. The heating and/or cooling device(s) may be attached to a front surface of the spine support member 28 or may be embedded therein for generating heat, cold or cycling between both. In one embodiment, one or more thermoelectric devices form part of the spine support member 28. The thermoelectric device(s) generate heat responsive to a bias voltage. Reversing the bias voltage polarity results in a cooling effect. A thermoelectric device can alternate between generating heat and cold by periodically changing the polarity of the bias voltage applied to the thermoelectric device. Thus, further back relief is provided by including one or more heating and/or cooling devices as part of the elongated spine support member 28.

With the above range of variations and applications in mind, it should be understood that the present invention is not limited by the foregoing description, nor is it limited by the accompanying drawings. Instead, the present invention is limited only by the following claims and their legal equivalents.

What is claimed is:

1. A chair, comprising:

a seat;

a back attached to the seat and having a first surface facing away from the seat and a second surface facing toward the seat;

padding attached to the second surface of the back;

a recess formed in the padding extending along a longitudinal center line of the back; and a generally vertically extending elongated spine support member embedded in the recess, the elongated spine support member including a backing layer attached to the second surface of the back, a foam layer and an intermediate air chamber interposed between the backing layer and the foam layer, a first part of the spine support member being positioned below a surface of the padding and a second part of the spine support member extending outward beyond the surface of the padding toward the seat, the spine support member configured to engage and support at least the thoracic and lumbar regions of the vertebral column of a person seated in the chair.

2. The chair of claim 1, wherein the spine support member has a generally uniform width.

3. The chair of claim 1, wherein the foam layer is a layer of viscoelastic foam and the air chamber is at least partially filled with air.

4. The chair of claim 3, wherein the air chamber is configured to displace the air responsive to a force applied by the vertebral column to the spine support member.

5. The chair of claim 1, wherein the air chamber comprises a first separate chamber configured to engage and support the lumbar region of the vertebral column and a second separate chamber configured to engage and support the thoracic region of the vertebral column, the first and second chambers being individually inflatable and deflatable.

6. The chair of claim 1, wherein the air chamber comprises a single continuous air chamber.

7. The chair of claim 1, wherein the air chamber and the foam layer have substantially the same length and substantially the same width.

8. The chair of claim 1, wherein the foam layer has a convex curved surface facing away from the air chamber.

9. The chair of claim 1, further comprising a pump configured to control an amount of air contained in the air chamber.

10. A portable back support, comprising:

a back having first and second opposing surfaces;

padding attached to the second surface of the back;

a recess formed in the padding extending along a longitudinal center line of the back; and a generally vertically extending elongated spine support member embedded in the recess, the elongated spine support member including a backing layer attached to the second surface of the back, a foam layer and an intermediate air chamber interposed between the backing layer and the foam layer, a first part of the spine support member being positioned below a surface of the padding and a second part of the spine support member extending outward beyond the surface of the padding, the spine support member configured to engage and support at least the thoracic and lumbar regions of the vertebral column of a person seated against the portable back support.

11. The portable back support of claim 10, wherein the air chamber comprises a single continuous air chamber.

12. The portable back support of claim 10, wherein the air chamber and the foam layer have substantially the same length and substantially the same width.

13. The portable back support of claim 10, wherein the foam layer has a convex curved surface facing away from the air chamber.

14. The portable back support of claim 10, wherein the foam layer is a layer of viscoelastic foam and the air chamber is at least partially filled with air.

15. The portable back support of claim 10, wherein the air chamber comprises a first separate chamber configured to engage and support the lumbar region of the vertebral column and a second separate chamber configured to engage and support the thoracic region of the vertebral column, the first and second chambers being individually inflatable and deflatable.

16. The portable back support of claim 10, wherein the spine support member has a generally uniform width.

17. The portable back support of claim 10, further comprising a pump configured to control an amount of air contained in the air chamber.

* * * * *